US006244304B1

(12) United States Patent
Hockemeyer et al.

(10) Patent No.: US 6,244,304 B1
(45) Date of Patent: Jun. 12, 2001

(54) DOUP END TENSION REGULATING DEVICE FOR A SELVEDGE FORMER

(75) Inventors: Kurt Hockemeyer; Christoph Schwemmlein, both of Borken-Weseke (DE)

(73) Assignee: Klocker-Entwicklungs GmbH, Borken-Weseke (DE)

( * ) Notice: Subject to any disclaimer, the term of this patent is extended or adjusted under 35 U.S.C. 154(b) by 0 days.

(21) Appl. No.: 09/530,026

(22) PCT Filed: Nov. 3, 1998

(86) PCT No.: PCT/DE98/03201

§ 371 Date: Apr. 21, 2000

§ 102(e) Date: Apr. 21, 2000

(87) PCT Pub. No.: WO99/23288

PCT Pub. Date: May 14, 1999

(30) Foreign Application Priority Data

Nov. 3, 1997 (DE) ..... 197 48 409

(51) Int. Cl.[7] ..... D03C 7/00; D03D 49/04

(52) U.S. Cl. ..... 139/54

(58) Field of Search ..... 242/129.2; 66/146; 139/54

(56) References Cited

U.S. PATENT DOCUMENTS

| | | | | |
|---|---|---|---|---|
| 2,389,258 | | 11/1945 | Hilton . | |
| 2,647,541 | | 8/1953 | Nichols . | |
| 2,704,558 | | 3/1955 | Masson et al. . | |
| 2,791,109 | * | 5/1957 | Piltz | 139/54 |
| 3,493,013 | * | 2/1970 | Lutz | 139/54 |
| 4,166,480 | * | 9/1979 | Muller | 139/54 |

FOREIGN PATENT DOCUMENTS

| | | |
|---|---|---|
| 26 05 489 | 3/1977 | (DE) . |
| 0 057 237 | 8/1982 | (EP) . |
| 0 371 257 | 6/1990 | (EP) . |
| 1 555 223 | 1/1969 | (FR) . |
| N00773 | 1/1914 | (GB) . |

* cited by examiner

*Primary Examiner*—Andy Falik
(74) *Attorney, Agent, or Firm*—James P. Hanrath

(57) ABSTRACT

In a leno selvedge device, an apparatus for adjusting thread tension of the doup ends and of the stationary threads that are guided through the leno selvedge forming device includes a holding structure accommodated directly in front of the leno selvedge device which keeps the stationary thread and/or the doup end under resilient tension. The holding structure includes at least one eyelet, through which thread is threaded. The eyelet is kept under tension by a spring and disposes the thread in a downward direction.

5 Claims, 3 Drawing Sheets

DOUP END TENSION REGULATING DEVICE FOR A SELVEDGE FORMER

BACKGROUND OF THE INVENTION

1. Field of the Invention

The present invention relates to a device for adjusting thread tension of the doup ends and of the stationary threads that are guided through a leno selvedge forming device.

2. Description of the Prior Art

Such a leno selvedge forming device may for example be embodied by a combination of lifting healds and half healds. As it is known, two lifting healds connected to two half healds hereby serve to produce a so-called leno selvedge. Such lifting healds are directly or indirectly fixed to the heald frames of a loom. The doup end is guided between half heald and lifting heald whereas the stationary thread is threaded through the eyelet of the half heald. Due to the alternate motion of the doup end from one side of the half heald to the other side of the half heald, the weft is tied together with the stationary thread by the thus created leno selvedge. The leno selvedge prevents the fabric from fluting this area.

A so-called holding-down appliance for the thread is located directly before such a leno selvedge forming device consisting of two lifting healds and one half heald, that is directly before the heald frames, said holding-down appliance for the thread always keeping the dour end and the stationary thread under tension as they are guided through the lifting heald and through the half heald respectively. This is necessary since only by holding down the doup end and the stationary thread respectively it is made certain that the doup end is capable of reliably wandering at each weft change from one side of the half heald to the other side of the half heald even on fast-running power looms.

Now as it is, when the shed is being opened, the doup end and the stationary thread respectively are submitted to tension due to the lengthening of the path. In order to keep this tension low, a spring assembly is provided in the area of the bobbins that compensates the lengthening of the doup end and of the stationary thread respectively. On their way from the lifting healds to the bobbin, the stationary thread as well as the doup end are deflected several times, whereas it turned out that, due to the many deflections and to the thus originated friction losses, the spring assembly accommodated on the bobbin no longer compensates the tension of the thread on the bobbin. This means that the lengthening of the thread that occurs when the shed is opened is substantially provided by the elasticity inherent to the thread. One disadvantage thereof is that the threads are subjected to high strain; another substantial drawback is that, since, when the shed is opened, the threads are subjected to strain and thread tension increases accordingly, the threads that are passing alongside the lifting healds are cutting in more because or the increased tension than they would if the tension remained lower. That means that the lifting healds wear more.

FR 15 55 223 discloses a similar device. Here, a heald is arranged before a leno selvedge forming device, whereas the doup end's tension is adjusted in front of the heald. A spring-loaded lever s provided to this end, whereas the ever is fitted at its end with the eyelet for the doup end. The disadvantage thereof is that the doup end is always stretched when the shed is opened so that the thread incurs the risk of tearing or cutting in in the leno selvedge forming device. This is due to the fact that the device in question can only restrictedly proceed to thread tension adjustment because of the heald that is arranged in front of the leno selvedge forming device.

SUMMARY OF THE INVENTION

The object of the present invention is therefore to provide a device for adjusting thread tension of the doup ends and of the stationary threads guided by the lifting heads that makes certain that the lengthening of the thread when the shed is opened has not to be brought about by the thread itself but that thread tension substantially remains the same without having the thread itself lengthened, as already explained above.

The solution of the invention is that a holding device accommodated directly in front of the leno selvedge device keeps the stationary thread and/or the doup end under resilient tension. By accommodating such a holding device directly in front of the leno selvedge forming device or in front of the lifting healds, compensation of thread tension may be achieved thanks to the spring effect of the holding device when the shed is opened. That means that the thread itself is not lengthening. The thread path needed when the shed is being opened is rather provided by the fact that the holding device has got a resilient configuration.

In detail, the holding device comprises at least one eyelet through which the thread(s) is/are threaded, whereas the eyelet is kept under tension by a spring element. The holding device hereby also keeps the thread down, just as a holding-down device for threads would do, that is, the thread is pulled in downward direction.

According to a feature of the invention, the spring element is configured as a springy arm, whereas the arm is spirally bent at its end to generate the spring force.

Advantageously, the angle between the respective arm and the thread amounts to between 70 and 110°, preferably to 90°. The advantage thereof is that, when thread tension and with it the excursion of the spring element changes, the height of the stationary thread or of the doup end respectively hardly changes, whereas the correct functioning in its quality as a holding-down device is not impaired thereby.

The invention will be explained more explicitely in the following with the help of the embodiment illustrated in the figures:

DESCRIPTION OF THE PREFERRED EMBODIMENT(S)

Figure 1:
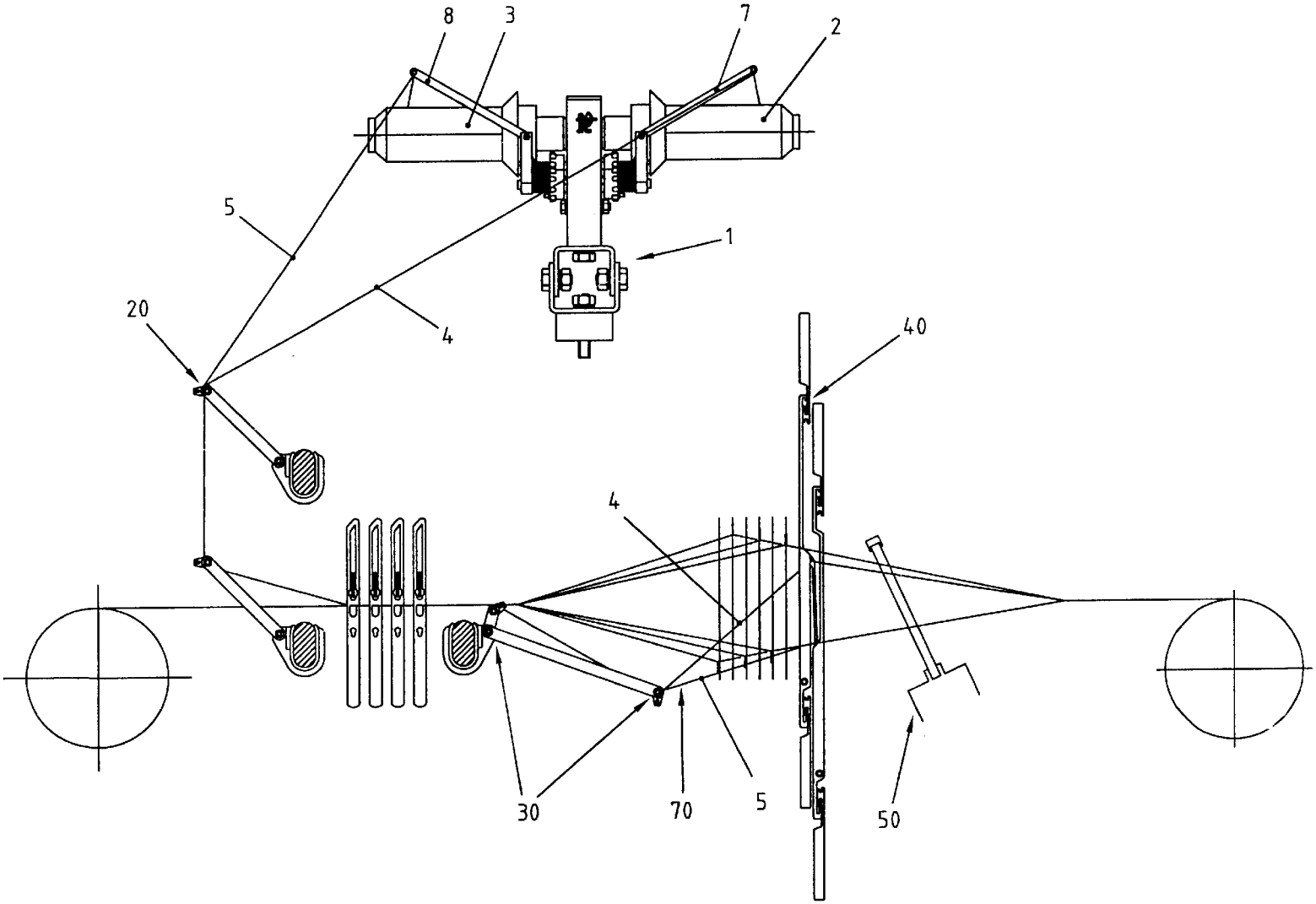
FIG. 1 is a schematic view according to the heretofor known prior art.

In FIG. 1, the overall bobbin carrier is referred to with numeral 1; the bobbin carrier 1 has the two bobbins 2 and 3 for receipt of the stationary thread or the doup end 4, 5 respectively. This bobbin carrier 1 is moreover provided with springy arms 7, 8 that serve to compensate diverging tensions in the threads 4, 5 while they are being unwound from the bobbins 2, 3.

The threads 4, 5 are deflected twice at the points 10, 20 before they reach the holding-down device for the thread 30 from which the threads are conveyed to the lifting healds 40. The reed, referred to as a whole with numeral 50, is connected behind the lifting healds 40. The function of the holding-down device 30 is to keep she threads 4, 5 under tension in the direction of the arrow 70.

Figure 2:
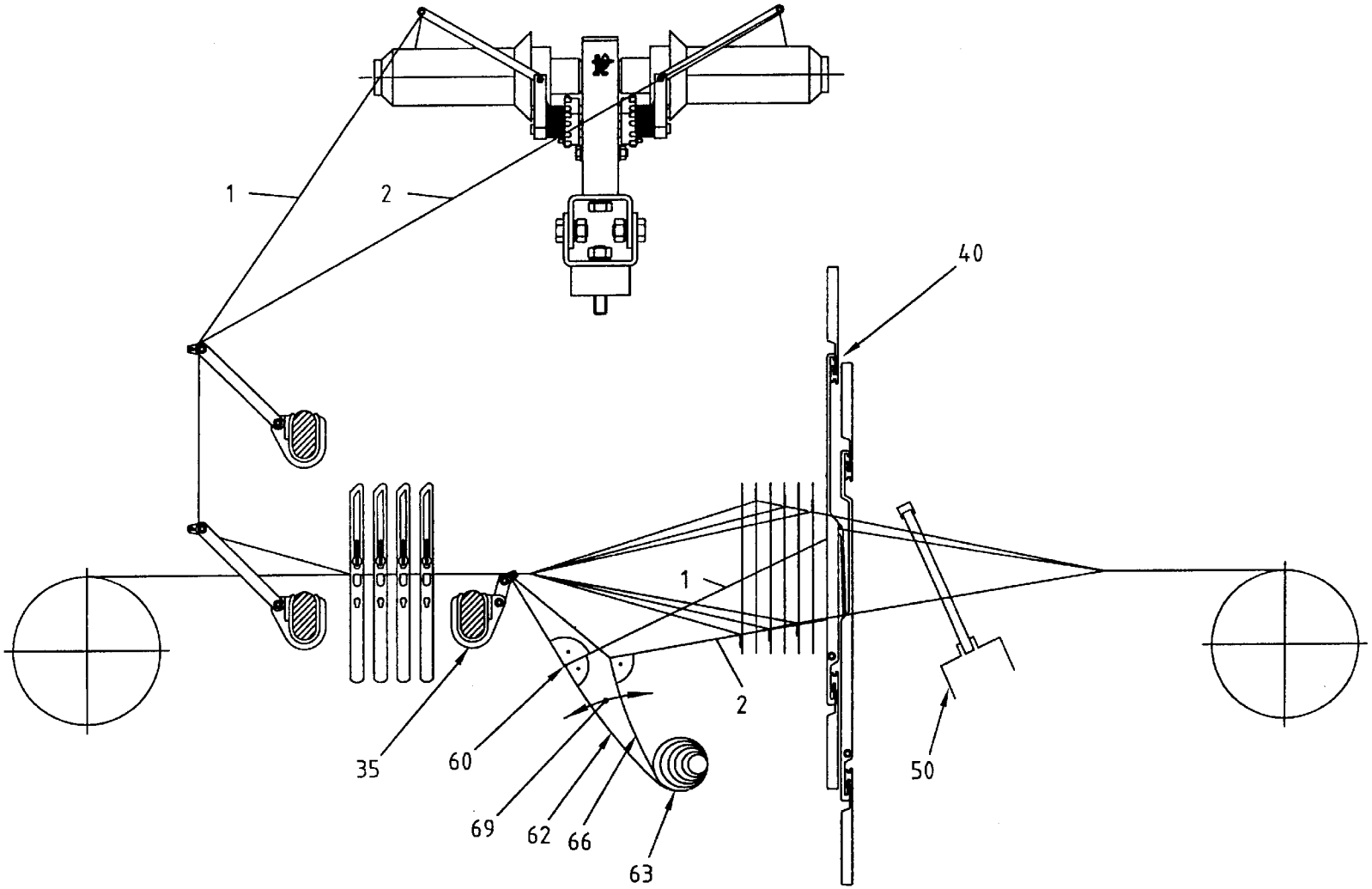
FIG. 2 shows the configuration according to the invention.
Figure 3:
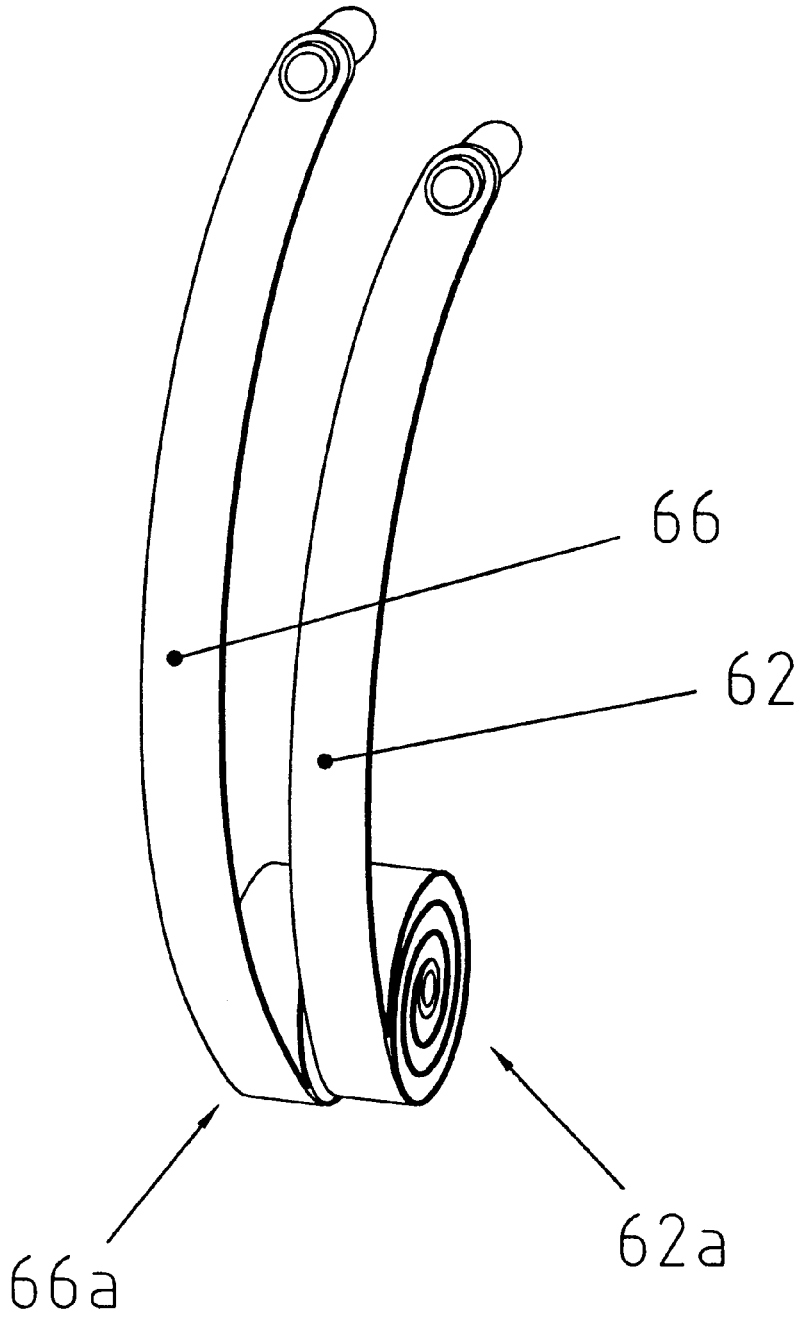
FIG. 3 is an enlarged view of the two arms of the holding device according to the invention.

According to FIG. 2 a thread guide 35 remains instead of the holding-down device 30, the threads 4, 5 being however threaded through a holding device 63 at 60, whereas said holding device has two springy arms 62, 66, one for the doup end and one for the stationary thread, whereas the threads are threaded through eyelets 61, 67 arranged at the end of the arms 62, 66. The resilient action of the arms 62, 66 is substantially achieved by the spiral configuration of the arms at their end at 62*a*, 66*a*. In the enlargement shown in FIG. 3, the two arms 62, 66 are located one behind the other in the plane of projection. The arrow 69 of FIG. 2 is meant to indicate how the springy arms deviate when tension is applied to the doup end or the stationary thread respectively due to the excursion of the lifting healds. The essential point hereby is that the angle between the alignment of the individual threads 4, 5 and of the arms 62, 66 amounts to approximately 90° in order to keep substantially constant the tension of the threads in any position or the arms. That means that, when the shed changes from the position of closed shed to the position of "open shed", the springy arms 52, 66 are, thanks to their resilient configuration, capable to give way to the required lengthening of the thread by tensioning the spring without the thread itself having to take up a substantially higher tension.

What is claimed is:

1. In a leno selvedge device, an apparatus for adjusting thread tension of doup ends and of stationary threads that are guided through the leno selvedge device, said apparatus being characterized in that a holding means (63) accommodated directly in front of the leno selvedge device keeps a stationary thread and/or a doup end (4, 5) under resilient tension, said holding means comprising a springy arm (62, 66) with at least one eyelet (61, 67) through which the thread(s) (4, 5) is/are threaded.

2. The apparatus according to claims 1, characterized in that the springy arm (62, 66) is spirally bent at its end to generate the spring force.

3. The apparatus according to claim 1, characterized in that the holding means (63) disposes the thread(s) (4, 5) in a downward direction by tension.

4. The apparatus according to claim 1, characterized in that the angle between the arm (62, 66) and the thread (4, 5) amounts to between 70 and 110°.

5. The apparatus according to claim 1, characterized in that the leno selvedge forming device comprises two lifting healds and one half heald which is taken along by the lifting healds.

* * * * *